United States Patent [19]

Feller et al.

[11] Patent Number: 4,835,441

[45] Date of Patent: May 30, 1989

[54] DIRECTLY HEATED SORPTION GETTER BODY

[75] Inventors: Heinrich Feller, Munich; Peter Mammach, Unterhaching; Manfred Kobale, Faistenhaar, all of Fed. Rep. of Germany

[73] Assignee: Standard Elektrik Lorenz Aktiengesellschaft, Fed. Rep. of Germany

[21] Appl. No.: 127,570

[22] Filed: Dec. 2, 1987

Related U.S. Application Data

[63] Continuation of Ser. No. 861,561, May 9, 1986, abandoned.

[30] Foreign Application Priority Data

May 9, 1986 [DE] Fed. Rep. of Germany ..... 3516786

[51] Int. Cl.[4] ..... H01J 7/18; H01J 17/24

[52] U.S. Cl. ..... 313/553; 313/562; 417/48

[58] Field of Search ..... 313/553, 555, 549, 562, 313/558; 417/48

[56] References Cited

U.S. PATENT DOCUMENTS 3,620,645 11/1971 Cella Porta et al. ..... 417/48 X
4,303,847 12/1981 Glaser ..... 313/549

FOREIGN PATENT DOCUMENTS 2204714 8/1973 Fed. Rep. of Germany .
1373473 11/1974 United Kingdom .

OTHER PUBLICATIONS

O'Hanlon et al., IBM Technical Disclosure Bulletin, vol. 17, No. 10, pp. 3140–3141, Mar. 1975.

*Primary Examiner*—Kenneth Wieder
*Attorney, Agent, or Firm*—Hill, Van Santen, Steadman & Simpson

[57] ABSTRACT

A heatable sorption getter body for reactive residual gas clean-up in sealed vessels is provided. The getter body includes an insulating member, two electrical contacts, and a getter composition applied over surface portions of the insulating member. The insulating member serves as a carrier for the getter composition. The getter precursor composition is applied preliminarily after which the resulting dried assembly is subjected to sintering to complete preparation of the getter composition before the getter body is positioned in a sealed vessel.

11 Claims, 1 Drawing Sheet

DIRECTLY HEATED SORPTION GETTER BODY

This is a continuation of application Ser. No. 861,561, filed May 9, 1986, now abandoned.

BACKGROUND OF THE INVENTION

1. Field Of The Invention

This invention lies in the field of directly heated sorption getter bodies for reactive residual gas clean-up in sealed vessels.

2. Prior Art

Getter sorption pumps comprising at least one getter body of nonevaporating getter material and an associated heating element are already known; such getter bodies are disclosed, for example, by German Patent No. 22 04 714.

Getter bodies hitherto employed which are composed, for example, of zircon-carbon were indirectly heated. An insulating jacket is thus applied between heater and getter compound. The heater, which is typically a tungsten helix, accordingly also serves as a carrier for the insulating jacket and the getter compound. The three-layered structure of heater insulating jacket getter compound is relatively involved. It has a tendency to craze, and a tendency to shortouts, between the heater and the getter jacket.

BRIEF SUMMARY OF THE INVENTION

More particularly, this invention relates to a new and very useful class of directly electrically heatable sorption getter bodies for clean-up of reactive residual gases in hermetically sealed vessels, particularly flat image display devices. Such a getter body includes an insulating member, two electrical contacts with associated means securing each one thereof in spaced relationship to the other thereof upon surface locations of said insulating member, and a getter composition applied over a surface portion or portions of said insulating member. Such surface portion(s) circumscribe said contacts whereby said insulating member serves as a carrier for said getter composition, said contact electrically engage the getter composition, and said getter composition continuously extends between said contacts.

A principal object of the present invention is to provide a high-capacity, directly electrically heated sorption getter body having a simple structure.

This object is achieved in accord with the invention by means of a directly heated sorption getter body. as above characterized.

Other and further objects, aims, purposes, features, advantages, and the like will be apparent to those skilled in the art from the teachings of the present specification taken with the accompanying drawings.

DETAILED DESCRIPTION

In a sorption getter body of the present invention, a getter compound is directly applied to an insulating member. Two electrical contacts of, for example, molybdenum, are fixed to the insulating member conveniently by pressing, or by point welding. Such contacts are fixed on the insulating member in the form of cylinders, tubes, rings, plates, or the like, as a carrier means for the getter compound. The carrier assembly, including regions around the contacts and the insulating member, is coated on exposed surface portions with a getter compound precursor. The coating can be accomplished by means of painting, dipping, spraying, silk-screening, or the like, as desired.

The getter body prepared in such fashion is subsequently sintered. A metallic connection thereby ensues between the two electrical contacts and the sintered getter compound. The sintering ensues in a vacuum furnace (about $10^{-3}$mbar) at elevated temperature (for example, about 900° C. for 30 minutes). In order to achieve mechanically solid sintered bodies, it is important to keep the heating rate in the vacuum furnace as low as possible so that the pressure in the system does not significantly exceed about $10^{-3}$mbar.

A finished getter body is activated by direct current passage. This occurs after the mounting of the getter body in the vacuum system provided for that purpose, and during or following the heating and pumping process. Since the specific resistance of the porous getter compound is higher by a multiple than that of, for example, solid zirconium, the current for the activation lies within justifiable limits. The getter layer can be made to have a thickness up to a few tenths of a millimeter, so that the capacity of getters manufactured as taught herein is substantially higher than that of traditional planar getters.

Upon activation of the described getter structures, the entire getter layer is uniformly heated due to the direct current passage. The risk of crazing the getter compound, and, thus, of loosening getter compound particles, is therefore nearly excluded.

Figure 1:
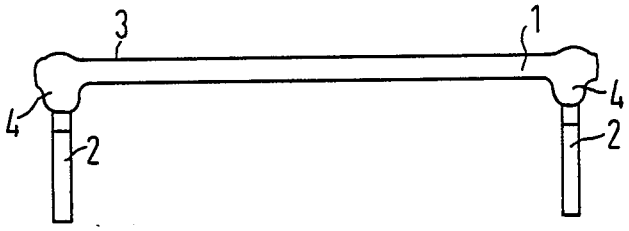
FIG. 1 is a side elevational view of one embodiment of a sorption getter body of the present invention.

Referring to FIG. 1, there is seen a sorption getter body of the invention which is composed of an insulating member 1 that is provided with two electrical contacts 2. The getter compound 3 is applied to the insulating member 1 serving as carrier and to the contact locations 4. An aluminum oxide rod having, for example, a diameter of 1 millimeter and a length of 45 mm is employed as insulating member 1, and molybdenum clips serve as the contacts which are fixed thereto by spot welding. The getter compound 3 is preferably composed of a mixture of zirconium powder having a grain size of, for example, about 5 μm and ammonium bicarbaminate (96:4 weight %) in a binder solution of, for example, collodion cotton which is dissolved in butyl acetate or isobutanol. The getter compound 3 is uniformly applied to the insulating member 1 and the contact locations 4 (terminal flange). The compound is first conveniently dried at room temperature for a few hours, or, alternatively, at 50° C. for about 10 minutes. The heating rate for the sintering process is controlled using the pressure in the vacuum furnace. Given a rate of 5° C./min., the pressure of $10^{-3}$mbar is not exceeded when employing conventional evacuation systems. The sintering temperature lies at about 900° C. and is maintained for about 20 minutes. The cooling occurs in a vacuum which the temperature is lowered down to at least about 80° C.

Figure 2:
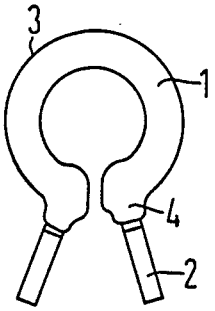
FIG. 2 is a front elevational view of another exemplary embodiment of a sorption getter body of the present invention.

Referring to FIG. 2, there is seen a slotted ring structure wherein the insulating member 1 is composed of beryllium oxide as sorption getter body. The getter compound 3 is applied to this insulating member 1 and the contact locations 4 thereof comprise the contacts 2.

Figure 3:
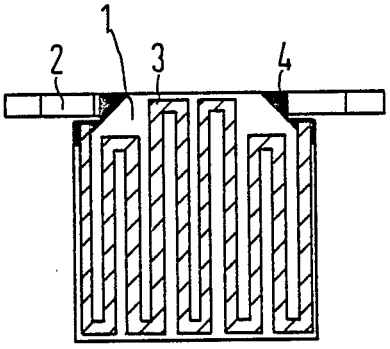
FIG. 3 is a plan view of a further exemplary embodiment of a sorption getter body of the present invention.

Referring to FIG. 3, there is seen employed as insulating member 1, an aluminum oxide plate whose dimensions amount, for example, to 20×20×0.5 mm. The contacts 2 are composed of molybdenum and the contact locations 4 (electrical terminal regions) are composed of a baking paste containing palladium powder. The getter compound 3 is subsequently applied, for example, by silk-screening, preferably in the form of a meander-shaped track. The sintering is carried out as in the preceding exemplary embodiments.

After the sintering process, the contacts 2 in this FIG. 3 embodiment comprising contact clips composed of molybdenum are connected by spot welding, or the like, to the contact locations 4, that is, for example, to the terminal region on the plate. A modified execution of tape fixing is accomplished by hard-soldering of the contacts 2 (Mo contact clips) to the contact locations 4 produced with baking paste, applied upon the electrical terminal surfaces.

Having now fully described the invention, it will be apparent to one of ordinary skill in the art that many changes and modifications can be made thereto without departing from the spirit or scope of the invention as set forth herein.

We claim:

1. A directly heatable sorption getter body for gas clean-up of reactive residual gases in hermetically sealed vessels, comprising:

an insulating member;

a getter composition applied over at least a portion of a surface of said insulating member, and said getter composition being electrically conductive and having a resistance associated therewith having a value chosen such that a direct heating of the getter composition occurs when electrical current is passed therethrough; and first and second spaced electrical contacts in electrical connection with respective portions of the getter composition, said contacts being positioned such that said getter composition continuously extends between said contacts and forms a continuous electrical resistance path between the contacts so that when a voltage is applied across the two electrical contacts, the getter body is directly heated.

2. A getter body according to claim 1 wherein said getter composition extends over said insulating member in a meander-like configuration.

3. A getter body according to claim 1 wherein said getter composition comprises a mixture of zirconium powder, ammonium bicarbaminate, and a binder.

4. A getter body according to claim 1 wherein the contacts comprise molybdenum.

5. A getter body according to claim 1 wherein said insulating member comprises a material selected from the group consisting of aluminum oxide, beryllium oxide, and mixtures thereof.

6. A getter body according to claim 1 wherein the insulating member comprises a longitudinally extending rod and the electrical contacts are connected to the rod and getter composition at opposite ends of the rod.

7. A getter body according to claim 1 wherein the insulating member is formed with a curved insulator member and the electrical contacts are connected to the ends of the insulating member and the getter composition.

8. A getter body according to claim 1 wherein the contacts include means for mechanical connection thereof to the insulating member, and wherein the getter composition overlies the means for mechanical connection so as to provide electrical connection to the contacts.

9. A getter body according to claim 1 wherein a metallic connection is provided between the getter composition and the electrical contacts, and the getter composition is sintered.

10. A getter body according to claim 1 wherein the getter composition is continuously distributed between the two contacts such that a substantially uniform and distributed heating of the getter composition occurs between the two electrical contacts when the electrical current passes therethrough.

11. A directly heatable sorption getter body for gas clean-up of reactive residual gases in hermetically sealed vessels, comprising:

a carrier member;

a getter composition on the carrier member, and said getter composition being electrically conductive and having a resistance associated therewith having a value chosen such that a direct heating of the getter composition occurs when electrical current is passed therethrough; and first and second spaced electrical contacts in electrical connection with respective portions of the getter composition, means for mechanically securing the electrical contacts relative to the carrier member, and said contacts being positioned such that said getter composition continuously extends between said contacts and forms a continuous electrical resistance path between the contacts so that when a voltage is applied to the two electrical contacts, the getter body is directly heated.

* * * * *